US010648425B2

(12) United States Patent
Miller et al.

(10) Patent No.: US 10,648,425 B2
(45) Date of Patent: May 12, 2020

(54) PISTON WITH BROAD OVATE GALLERY

(71) Applicant: Federal-Mogul LLC, Southfield, MI (US)

(72) Inventors: Andrew J. Miller, Plymouth, MI (US); Juan Gildemeister, Howell, MI (US); Dawnelle Wielosinski, Livonia, MI (US)

(73) Assignee: Tenneco Inc., Lake Forest, IL (US)

( * ) Notice: Subject to any disclaimer, the term of this patent is extended or adjusted under 35 U.S.C. 154(b) by 0 days.

(21) Appl. No.: 16/109,328

(22) Filed: Aug. 22, 2018

(65) Prior Publication Data

US 2019/0063365 A1 Feb. 28, 2019

Related U.S. Application Data

(60) Provisional application No. 62/549,055, filed on Aug. 23, 2017.

(51) Int. Cl.

| | |
|---|---|
| ***F01P 3/10*** | (2006.01) |
| ***F02F 3/22*** | (2006.01) |
| ***F02F 3/00*** | (2006.01) |

(52) U.S. Cl.

CPC ..... *F02F 3/22* (2013.01); *F01P 3/10* (2013.01); *F02F 3/0084* (2013.01); *F05C 2201/021* (2013.01)

(58) Field of Classification Search

USPC ..... 123/41.35, 196.6; 29/888.04, 888.042, 29/888.044, 527.5; 92/208

See application file for complete search history.

(56) References Cited

U.S. PATENT DOCUMENTS

| | | | |
|---|---|---|---|
| 1,841,796 A | 1/1932 | Edwards | |
| 6,279,455 B1 | 8/2001 | Kruse | |
| 7,895,936 B2 | 3/2011 | Hofbauer | |
| 8,683,913 B2 | 4/2014 | Sikorsky et al. | |
| 9,416,750 B2 * | 8/2016 | Bischofberger | .... F02B 23/0603 |
| 9,494,106 B2 | 11/2016 | Bischofberger | |
| 9,687,942 B2 | 6/2017 | Flowers | |
| 9,759,119 B2 | 9/2017 | Mackenzie et al. | |
| 9,765,728 B2 | 9/2017 | Bischofberger et al. | |

(Continued)

FOREIGN PATENT DOCUMENTS

| | | |
|---|---|---|
| AT | 001919 U1 | 1/1998 |
| CN | 102444496 A | 5/2012 |

(Continued)

OTHER PUBLICATIONS

International Search Report, dated Nov. 12, 2018 (PCT/US2018/047623).

*Primary Examiner* — George C Jin
*Assistant Examiner* — Teuta B Holbrook
(74) *Attorney, Agent, or Firm* — Robert L. Stearns; Dickinson Wright, PLLC

(57) ABSTRACT

An aluminum piston including a cooling gallery with titled inner and outer side walls is provided. The piston comprises a ring belt with a ring grooves, and an iron insert is disposed in a top one of the ring grooves. To reduce stress and mass of the piston, material located under the iron insert is removed, so that the outer side wall of the cooling gallery is tilted toward the center axis. The inner side wall of the cooling gallery is tilted away from the center axis.

16 Claims, 2 Drawing Sheets

(56) References Cited

U.S. PATENT DOCUMENTS

| | | | | |
|---|---|---|---|---|
| 2009/0159037 | A1 | 6/2009 | Messmer | |
| 2013/0000482 | A1* | 1/2013 | Kopchick | B22C 9/00 92/172 |
| 2013/0032104 | A1* | 2/2013 | Andreas | B22C 9/105 123/41.35 |
| 2015/0128892 | A1* | 5/2015 | Bischofberger | F02F 3/18 123/193.6 |
| 2015/0315995 | A1* | 11/2015 | Weinenger | F02F 3/18 123/41.35 |
| 2016/0201544 | A1* | 7/2016 | MacKenzie | F01P 3/10 123/41.35 |
| 2019/0048822 | A1* | 2/2019 | Germano | F02F 3/22 |

FOREIGN PATENT DOCUMENTS

| | | | | | |
|---|---|---|---|---|---|
| DE | 10230746 | A1 | | 1/2004 | |
| DE | 10247728 | A1 | | 4/2004 | |
| DE | 102007020384 | A1 | | 11/2008 | |
| DE | 102011013141 | A1 | * | 9/2012 | B21K 1/185 |
| DE | 102012211060 | A1 | | 4/2014 | |
| EP | 0474332 | A1 | | 3/1992 | |
| EP | 1875977 | A1 | | 1/2008 | |
| JP | 2002221086 | A | | 8/2002 | |
| KR | 20030030245 | A | * | 4/2003 | |
| WO | WO-2014032644 | A2 | * | 3/2014 | F02F 3/18 |

* cited by examiner

PISTON WITH BROAD OVATE GALLERY

CROSS-REFERENCE TO RELATED APPLICATION

This U.S. utility patent application claims priority to U.S. provisional patent application No. 62/549,055, filed Aug. 23, 2017, the entire disclosure of which is incorporated herein by reference.

BACKGROUND OF THE INVENTION

1. Technical Field

This invention relates generally to pistons for internal combustion engines, and methods of manufacturing the pistons.

2. Related Art

Aluminum pistons for internal combustion systems of automotive vehicles typically include a crown with a closed cooling gallery for retaining cooling fluid and reducing the temperature of the piston. The cooling gallery typically extends circumferentially between a center axis and a ring belt of the piston.

To reduce stress in aluminum pistons, the cooling gallery can be tilted 10 to 20 degrees. For example, as shown in FIG. 1, parallel side walls of the cooling gallery can be tilted 10 to 20 degrees away from the center axis of the piston. However, the tilting results in mass increase of the piston, especially when the piston also contains an insert formed of iron disposed in a top ring groove of the ring belt. When the iron insert is located in the top groove, the gallery is pushed toward the center axis of the piston to allow for casting stock, specifically aluminum material, between the cooling gallery and the iron insert. This leaves a significant amount of mass, due to the amount of aluminum material under the iron insert.

SUMMARY

One aspect of the invention includes a piston designed to provide low stress and reduced mass and thus improved performance during operation in an internal combustion engine. The piston includes a body portion formed of an aluminum material and extending around a center axis. The body portion includes a crown containing a cooling gallery. The crown also presents a combustion surface and includes a ring belt with a plurality of ring grooves. The ring grooves include a top ring groove located closer to the combustion surface than the other ring grooves. The cooling gallery of the body portion includes an inner side wall and an outer side, the inner side wall is tilted away from the center axis of the body portion, and the outer side wall is tilted toward the center axis of the body portion. An insert is disposed in the top ring groove of the ring belt.

Another aspect of the invention provides a method of manufacturing a piston. The method includes providing a body portion formed of an aluminum material and extending around a center axis. The body portion includes a crown containing a cooling gallery, the crown presents a combustion surface, the crown includes a ring belt with a plurality of ring grooves, the ring grooves include a top ring groove located closer to the combustion surface than the other ring grooves, the cooling gallery of the body portion includes an inner side wall and an outer side, the inner side wall of the cooling gallery is tilted away from the center axis of the body portion, and the outer side wall of the cooling gallery is tilted toward the center axis of the body portion. The method further includes disposing an insert in the top ring groove of the ring belt.

BRIEF DESCRIPTION OF THE DRAWINGS

These and other aspects, features and advantages of the invention will become more readily accompanying drawings, in which.

DETAILED DESCRIPTION OF EXEMPLARY EMBODIMENTS

Figure 1:
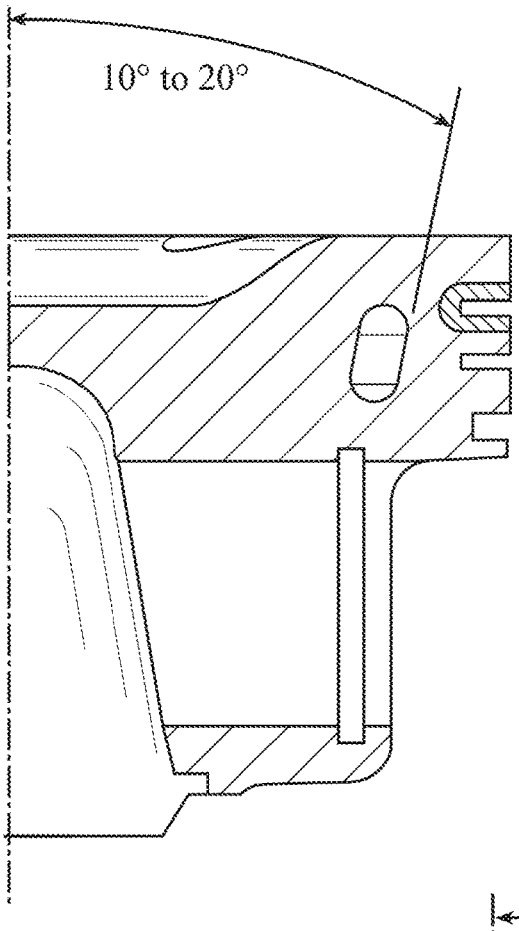
FIG. 1 is a cross-sectional side view of a portion of a comparative piston including a tilted cooling gallery.
Figure 2:
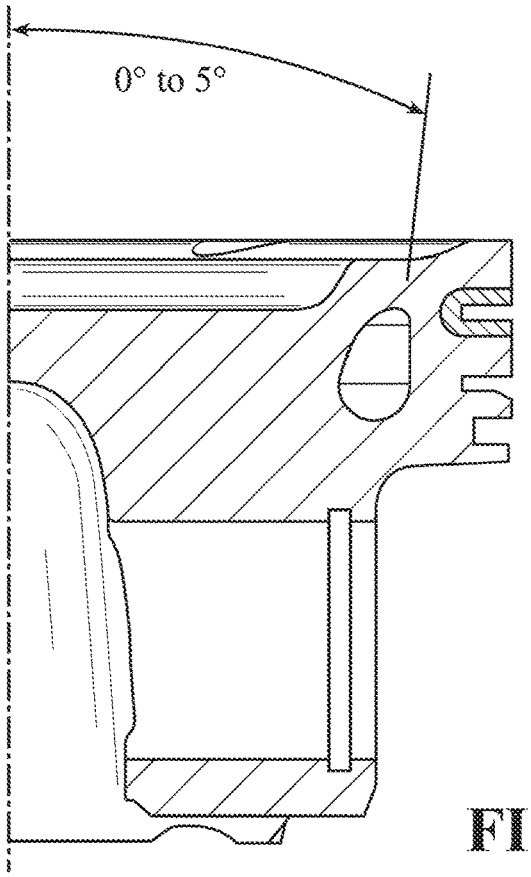
FIG. 2 is a cross-sectional side view of a portion of a piston including a tilted cooling gallery according to another comparative embodiment.

The invention provides an improved aluminum piston 10 for an internal combustion engine of an automotive vehicle. The piston 10 includes a tilted cooling gallery 12 for reducing stress, but has a reduced mass compared to other pistons 10 with tilted cooling galleries, such as the pistons of FIGS. 1 and 2. The low stress and reduced mass provided by the piston 10 of the present invention provides for improved performance of the internal combustion engine.

Figure 3:
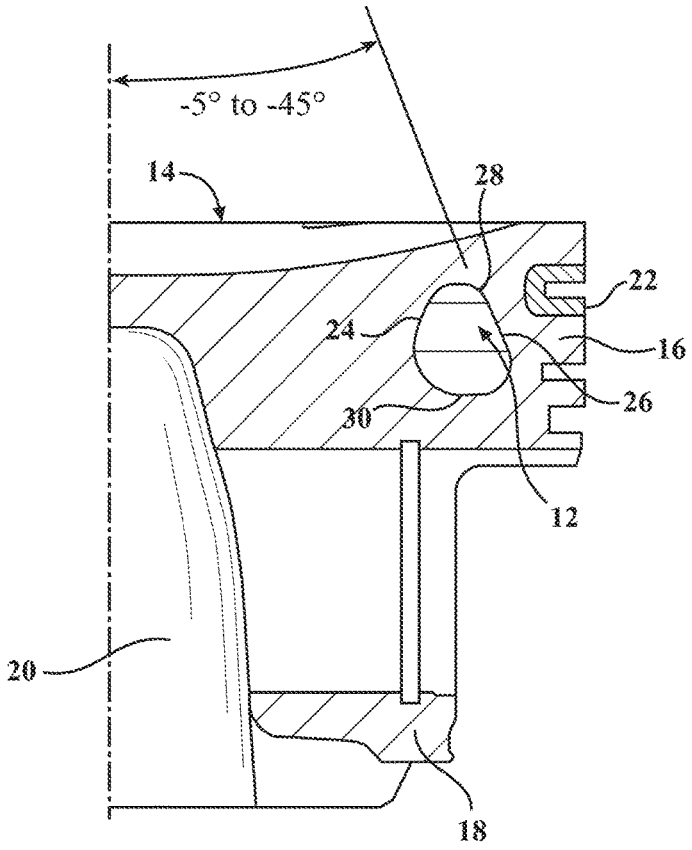
FIG. 3 is a cross-sectional side view of a portion of a piston including a cooling gallery according to an example embodiment of the invention.
Figure 4:
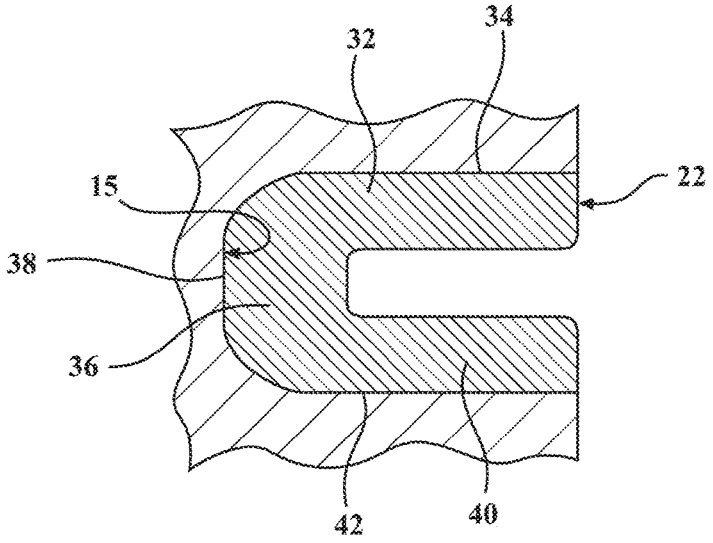
FIG. 4 is an enlarged view of the insert of the example embodiment of FIG. 3.

FIG. 3 illustrates an example of the reduced-mass piston 10 according to an example embodiment. The piston 10 includes a body portion formed of an aluminum material, such as aluminum, an aluminum alloy, or another material formed primarily of aluminum. The body portion extends circumferentially around a center axis of the piston 10. The piston 10 can have various different designs but in each case includes a crown 14 containing the cooling gallery 12, and a ring belt 16 containing a plurality of ring grooves. The crown 14 of the piston 10 also includes a combustion surface with a combustion bowl for exposure to a combustion chamber of the internal combustion engine. In the example embodiment of FIG. 3, the piston 10 further includes pin bosses 18 with pin bores and also a skirt 20 depending from the crown 14. Furthermore, the piston 10 can include an insert 22 formed of iron disposed in a top ring groove 15 of the ring belt 16. The top ring groove 15 is located closer to the combustion surface than the other ring grooves. An example of the insert 22 is shown in FIG. 3. The insert 22 of the example embodiment extends circumferentially around the center axis and is designed to match the shape of the top ring groove 15. FIG. 4 is an enlarged view of the insert 22 of the example embodiment. In this embodiment, the insert 22 includes an upper wall 32 disposed along an upper surface 34 of the top ring groove 15. The insert 22 also includes an inside wall 36 disposed along an inside surface 38 of the top ring groove 15, and a lower wall 40 disposed along a lower surface 42 of the top ring groove 15. The lower wall 40 is spaced from the upper wall 32 by a gap, which in this case is air gap.

The cooling gallery 12 of the piston 10 includes an inner side wall 24 and an outer side wall 26 connected by a top wall 28 and a bottom wall 30. The inner side wall 24 is located closer to the center axis A of the piston 10 than the outer side wall 26, and the outer side wall 26 is located closer to the ring belt 16 than the inner side wall 24. In the example embodiment of FIG. 3, the inner side wall 24 of the cooling gallery 12 is tilted away from the center axis of the piston 10 and toward the inside or inner diameter of the cooling gallery 12. The tilted inner side wall 24 provides proper strength to the piston 10. The outer side wall 26 is tilted toward the center axis and toward the inside or inner diameter of the cooling gallery 12. The inner side wall 24, the outer side wall 26, the top wall 28, and the bottom wall 30 can all be concave, when viewing the walls 24, 26, 28, 30 from the center of the cooling gallery 12. In addition, the inner and outer side walls 24, 26 are typically longer than the top wall 28 and the bottom wall 30. In the example embodiment, the bottom wall 30 is wider than the top wall 28, at least a portion of the inner side wall 24 and at least a portion of the outer side wall 26 are concave, the inner side wall 24 is more concave than the outer side wall 26, and a portion of the outer side wall 26 is flat in a center portion and curves toward the bottom wall 30.

To reduce mass of the piston 10, a portion of aluminum material adjacent the ring belt 16 is removed, such that the outer side wall 26 of the cooling gallery 12 is tilted in a direction toward the center axis of the piston 10 and the inside of the cooling gallery 12. In the example embodiment, the outer side wall 26 is tilted −5 to −45 degrees relative to the center axis of the body portion. In other words, the outer side wall 26 and the center axis of the body portion present an angle ranging from 5 to 45 degrees therebetween. Typically, the mass of the piston 10 is reduced by 5 to 8 g compared to the pistons of FIGS. 1 and 2. For example, according to one embodiment, the volume of the cooling gallery 12 is 10 to 12% of the total volume of the body portion of the piston 10. In the comparative examples of FIGS. 1 and 2, the volume of the cooling gallery is typically 8 to 9% of the total volume of the body portion of the piston. The total volume of the body portion includes the volume of the cooling gallery 12. The cooling gallery 12 of the piston 10 is typically larger than the cooling gallery of comparative pistons with tilted cooling galleries, for example the pistons of FIGS. 1 and 2.

Another aspect of the invention provides a method of manufacturing the piston 10 formed of aluminum material and including the tilted cooling gallery 12 with reduced mass. The method includes forming the crown 14 containing the cooling gallery 12 and the ring belt 16 containing the ring grooves. The crown 14 can be formed by casting, forging, and/or other methods. As discussed above, the cooling gallery 12 includes the inner side wall 24 and the outer side wall 26. The inner side wall 24 is located closer to the center axis of the piston 10, and the outer side wall 26 is located closer to the ring belt 16. The inner side wall 24 of the cooling gallery 12 is tilted away from the center axis of the piston 10 and toward the inner diameter of the cooling gallery 12.

To reduce mass of the piston 10, the method further includes removing a portion of aluminum material adjacent the ring belt 16, or providing a larger cooling gallery 12 relative to the comparative pistons with tilted cooling galleries, such that the outer side wall 26 of the cooling gallery 12 is tilted in a direction toward the center axis of the piston 10. The larger cooling gallery 12 can be provided during the step of forming the crown 14, such as during the casting or forging process. For example, the casting mold can be designed to provide the larger cooling gallery 12. Alternatively, the method can include removing a portion of the aluminum material along the ring belt 16, for example by machining, cutting, and/or another method. In the example embodiment, areas of the crown 14 below the ring insert 22 are hollowed out, while maintaining the outer side wall 26 tilted toward the inner diameter or inside of the cooling gallery 12.

The piston 10 and method provided by the present invention has numerous advantages. For example, the cooling gallery 12 of the aluminum piston 10 maintains a tilted inner diameter face or inner wall 24 to insure proper strength while removing non-structural mass below the iron groove insert 22. As discussed above, the inner diameter face or inner wall 24 of the cooling gallery 12 is tilted; the non-structural area under the cooling gallery 12, under the iron insert 22, and behind the ring grooves is hollowed out for mass reduction; the outer diameter face or outer wall 26 of the cooling gallery 12 is tilted backward and can be concave to give clearance to the iron ring insert 22; and the bottom wall 30 of the cooling gallery 12 is significantly wider than the top wall 28. The cooling gallery 12 design removes significant mass from below the cooling gallery 12 and below iron ring insert 22, and from behind the ring grooves, while maintaining the structural inner diameter surface or inner side wall 24.

Many modifications and variations of the present invention are possible in light of the above teachings and may be practiced otherwise than as specifically described while within the scope of the claims. It is also contemplated that all features of all claims and of all embodiments can be combined with each other, so long as such combinations would not contradict one another.

What is claimed is:

1. A piston, comprising:

a body portion formed of an aluminum material and extending around a center axis, said body portion including a crown containing a cooling gallery, said crown presenting a combustion surface, said crown including a ring belt with a plurality of ring grooves, said ring grooves including a top ring groove located closer to said combustion surface than the other ring grooves, said cooling gallery of said body portion including an inner side wall and an outer side wall, said inner side wall of said cooling gallery being tilted away from said center axis of said body portion, said outer side wall of said cooling gallery being tilted toward said center axis of said body portion, said outer side wall and said center axis of said body portion presenting an angle ranging from 5 to 45 degrees therebetween, said cooling gallery having a volume, said body portion of said piston having a volume which includes said volume of said cooling gallery, and said volume of said cooling gallery being 10 to 12% of said volume of said body portion, and an insert disposed in said top ring groove of said ring belt.

2. A piston according to claim 1, wherein said inner side wall and said outer side wall of said cooling gallery are connected by a top wall and a bottom wall, and said inner and outer side walls of said cooling gallery are longer than said top wall and longer than said bottom wall.

3. A piston according to claim 1, wherein said inner side wall and said outer side wall of said cooling gallery are connected by a top wall and a bottom wall, and said bottom wall is wider than said top wall of said cooling gallery.

4. A piston according to claim 1, wherein at least a portion of said inner side wall and at least a portion of said outer side wall are concave when viewing said walls from a center of said cooling gallery.

5. A piston according to claim 1, wherein said inner side wall and said outer side wall of said cooling gallery are connected by a top wall and a bottom wall, and said top wall and said bottom wall are concave when viewing said walls from a center of said cooling gallery.

6. A piston according to claim 1, wherein said inner side wall and said outer side wall of said cooling gallery are connected by a top wall and a bottom wall, said inner side wall of said cooling gallery is more concave than said outer side wall, and a portion of said outer side wall is flat in a center portion and curves toward said bottom wall.

7. A piston according to claim 1, wherein said insert is formed of iron.

8. A piston according to claim 1, wherein said insert extends circumferentially around a center axis of said piston.

9. A piston according to claim 1, wherein said insert includes an upper wall disposed along an upper surface of said top ring groove, an inside wall disposed along an inside surface of said top ring groove, a lower wall disposed along a lower surface of said top ring groove, and said lower wall is spaced from said upper wall of said insert by a gap.

10. A piston according to claim 1, wherein said aluminum material of said body portion is aluminum, an aluminum alloy, or another material formed primarily of aluminum, said combustion surface of said crown includes a combustion bowl for exposure to a combustion chamber of an internal combustion engine, said body portion includes pin bosses depending from said crown, said pin bosses include pin bores, said body portion includes a skirt depending from said crown, said inner side wall and said outer side wall of said cooling gallery are connected by a top wall and a bottom wall, said inner side wall of said cooling gallery is located closer to said center axis of said body portion than said outer side wall, said outer side wall is located closer to said ring belt than said inner side wall, at least a portion of said inner side wall, said outer side wall, said top wall, and said bottom wall are concave when viewing said walls from a center of said cooling gallery, said inner and outer side walls are longer than said top wall and longer than said bottom wall, said bottom wall is wider than said top wall, said inner side wall is more concave than said outer side wall, and a portion of said outer side wall is flat in a center portion and curves toward said bottom wall, said cooling gallery has a volume, said body portion of said piston has a volume which includes said volume of said cooling gallery, said insert is formed of iron and extends circumferentially around said center axis, said insert includes an upper wall disposed along an upper surface of said top ring groove, said insert includes an inside wall disposed along an inside surface of said top ring groove, and said insert includes a lower wall disposed along a lower surface of said top ring groove.

11. A method of manufacturing a piston, comprising the steps of:

providing a body portion formed of an aluminum material and extending around a center axis, the body portion including a crown containing a cooling gallery, the crown presenting a combustion surface, the crown including a ring belt with a plurality of ring grooves, the ring grooves including a top ring groove located closer to the combustion surface than the other ring grooves, the cooling gallery of the body portion including an inner side wall and an outer side wall, the inner side wall of the cooling gallery being tilted away from the center axis of the body portion, the outer side wall of the cooling gallery being tilted toward the center axis of the body portion, the outer side wall and the center axis of the body portion presenting an angle ranging from 5 to 45 degrees therebetween, the cooling gallery having a volume, the body portion of the piston having a volume which includes the volume of the cooling gallery, and the volume of the cooling gallery being 10 to 12% of the volume of the body portion, and disposing an insert in the top ring groove of the ring belt.

12. A method according to claim 11, wherein the inner side wall and the outer side wall of the cooling gallery are connected by a top wall and a bottom wall, and the inner and outer side walls of the cooling gallery are longer than the top wall and longer than the bottom wall.

13. A method according to claim 11, wherein the inner side wall and the outer side wall of the cooling gallery are connected by a top wall and a bottom wall, and the bottom wall is wider than the top wall of the cooling gallery.

14. A method according to claim 11, wherein the inner side wall and the outer side wall are concave when viewing the walls from a center of the cooling gallery.

15. A method according to claim 11, wherein the insert is formed of iron.

16. A method according to claim 11, wherein the insert extends circumferentially around a center axis of the piston.

* * * * *